US005932972A

United States Patent [19]

Symons

[11] Patent Number: 5,932,972

[45] Date of Patent: Aug. 3, 1999

[54] ELECTRON GUN FOR A MULTIPLE BEAM KLYSTRON

[75] Inventor: Robert Spencer Symons, Los Altos, Calif.

[73] Assignee: Litton Systems, Inc., Woodland Hills, Calif.

[21] Appl. No.: 08/804,808

[22] Filed: Feb. 24, 1997

[51] Int. Cl.[6] ..... H01J 25/10

[52] U.S. Cl. ..... 315/5.16; 315/5.33; 315/5.37; 315/5.51; 313/293; 313/447

[58] Field of Search ..... 315/5.14, 5.16, 315/5.33, 5.37, 5.39, 5.51; 313/293, 296, 297, 447

[56] References Cited

U.S. PATENT DOCUMENTS

| | | | |
|---|---|---|---|
| 2,399,223 | 4/1946 | Haeff | 315/5.16 |
| 2,482,766 | 9/1949 | Hansen et al. | 315/5.16 X |
| 3,107,313 | 10/1963 | Hechtel | 315/5.16 |
| 3,160,782 | 12/1964 | Rich | 315/5.37 |
| 3,484,645 | 12/1969 | Drees | 313/296 X |
| 4,433,270 | 2/1984 | Drozdov | 315/5.39 X |
| 4,583,021 | 4/1986 | Herriott et al. | 315/5.37 X |
| 4,593,230 | 6/1986 | True | 313/349 X |
| 4,733,131 | 3/1988 | Tran et al. | 315/5.14 |
| 4,745,324 | 5/1988 | True | 313/296 |
| 4,873,468 | 10/1989 | Miram et al. | 313/411 |
| 4,994,709 | 2/1991 | Green et al. | 313/447 X |
| 5,045,749 | 9/1991 | Desmur | 313/305 |

FOREIGN PATENT DOCUMENTS

| | | |
|---|---|---|
| 0 724 281 | 7/1996 | European Pat. Off. . |
| 3-106657 | 11/1991 | Japan . |
| 4-58938 | 5/1992 | Japan . |
| 4-215233 | 8/1992 | Japan . |
| 5-114363 | 5/1993 | Japan . |
| 8-264127 | 10/1996 | Japan . |
| 1136666 | 3/1994 | U.S.S.R. . |
| 2 020 482 | 11/1979 | United Kingdom . |
| 2 291 322 | 1/1996 | United Kingdom . |

*Primary Examiner*—Benny T. Lee
*Attorney, Agent, or Firm*—Graham & James LLP

[57] ABSTRACT

An electron gun provides multiple convergent beamlets in a rectilinear flow for use in multiple drift tubes of a multiple beam klystron. The electron gun comprises a cathode having a concave emitting surface and an anode having a concave surface defined by respective ends of a plurality of hollow drift tubes. The anode surface is spaced from the cathode surface and has a positive voltage potential applied thereto to define a series of equipotential contour surfaces between the cathode and the anode. A plurality of grids are located between the cathode and the anode, with each one of the grids being disposed coincident with a respective one of the equipotential contour surfaces with a first one of the grids located closely adjacent to the cathode surface. Each one of the grids further has a plurality of perforations extending therethrough in substantial registration with each other and with respective openings of the plurality of drift tubes. A plurality of electron beamlets are drawn from the cathode surface through respective ones of the plurality of perforations and into respective ones of the plurality of drift tubes.

5 Claims, 3 Drawing Sheets

ELECTRON GUN FOR A MULTIPLE BEAM KLYSTRON

BACKGROUND OF THE INVENTION

1. Field of the Invention

The present invention relates to linear beam electron devices, and more particularly, to an electron gun which provides multiple convergent electron beamlets suitable for use in a multiple beam klystron.

2. Description of Related Art

Linear beam electron devices are used in sophisticated communication and radar systems which require amplification of a radio frequency (RF) or microwave electromagnetic signal. A conventional klystron is an example of a linear beam electron device used as a microwave amplifier. In a klystron, an electron beam originating from an electron gun is caused to propagate through a drift tube that passes across a number of gaps which define resonant cavities of the klystron. The electron beam is velocity modulated by an RF input signal introduced into one of the resonant cavities. The velocity modulation of the electron beam results in electron bunching due to electrons that have had their velocity increased gradually overtaking those that have been slowed. The traveling electron bunches represent an RF current in the electron beam, which induces electromagnetic energy into a subsequent one of the resonant cavities. The electromagnetic energy may then be extracted from the subsequent resonant cavity as an amplified RF output signal.

Ever since the invention of the klystron, it has been recognized that a klystron having multiple beams in a bundle of separate drift tubes would have certain advantages over a klystron having a single electron beam in a single drift tube. If the gaps of the klystron are formed by the ends of the multiple drift tube bundles facing each other in an aligned fashion, the electric fields across each gap would be stronger and more uniform than would be the fields across a gap of a single drift tube. In addition, electrons in one of the drift tubes would be isolated from electrons in other ones of the drift tubes, so the electron repulsive forces, referred to as debunching forces, would be less. In theory, a high current, low voltage, multiple beam klystron would yield the same efficiency and power as a conventional klystron having a single low current electron beam operating at a much higher voltage. Also, a multiple beam klystron could achieve much more bandwidth than a conventional klystron because the fringing capacitance and electric field around the bundle of drift tubes at each gap would be a smaller fraction of the useful electric field in the gap which interacts with the electrons.

Despite the potential advantages of multiple beam klystrons, such devices have only been adapted for certain low power or low frequency applications in which a convergent electron beam is not necessary. In these non-convergent devices, electron beam focusing is provided by immersing the electron gun and drift tubes in a strong magnetic field which guides the electrons along the magnetic flux lines to the drift tubes. In one such approach, an electron gun was provided with a plurality of individual cathodes placed side by side, though this electron gun proved to be impractical since the individual cathodes could not be made to operate simultaneously. In an alternative approach, an electron gun was provided with a plurality of electron emitting spots driven by a common heater. Multiple beam klystrons incorporating such an electron gun have demonstrated lower operating voltage for the same bandwidth and power as a conventional helix traveling wave tube amplifier, as well as higher efficiency without using a multi-staged depressed collector. Nevertheless, the non-convergent electron beams of the prior art devices have limited current density which prevent them from developing more power at higher frequencies. In view of the difficulty in forming a converging group of electron beams suitable for use in the bundle of drift tubes, a multiple beam klystron has not been adapted for high power operation.

Accordingly, it would be desirable to provide a convergent electron gun having a plurality of high current beamlets that could be focused into multiple drift tubes with reasonable current density at the cathode of the electron gun. Such an electron gun would permit construction of a multiple beam klystron that would provide high operating power at high frequencies.

SUMMARY OF THE INVENTION

In accordance with the teachings of the present invention, an electron gun provides multiple convergent beamlets in a rectilinear flow for use in multiple drift tubes of a multiple beam klystron.

The electron gun comprises a cathode having a concave emitting surface and an anode having a concave surface defined by respective ends of a plurality of hollow drift tubes. The anode surface is spaced from the cathode surface and has a positive voltage potential applied thereto to define a series of equipotential contour surfaces between the cathode and the anode. A plurality of grids are located between the cathode and the anode, with each one of the grids being disposed coincident with a respective one of the equipotential contour surfaces with a first one of the grids located closely adjacent to the cathode surface. Each one of the grids further has a plurality of perforations extending therethrough in substantial registration with each other and with respective openings of the plurality of drift tubes. A plurality of electron beamlets are drawn from the cathode surface through respective ones of the plurality of perforations and into respective ones of the plurality of drift tubes.

In an embodiment of the invention, the electron gun is utilized in a multiple beam klystron having a first resonant cavity defined by a first gap provided in the plurality of drift tubes, and a second resonant cavity defined by a second gap provided in the plurality of drift tubes. An electromagnetic signal is coupled into the first resonant cavity, which velocity modulates the beamlets traveling in the plurality of drift tubes. The velocity modulated beamlets then induce an electromagnetic signal into the second resonant cavity, which may then be extracted from the klystron as a high power microwave signal. A collector is disposed at second respective ends of the plurality of drift tubes, which recovers the remaining energy of the beamlets after passing across the first and second gaps.

A more complete understanding of the electron gun for a multiple beam klystron will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 1:
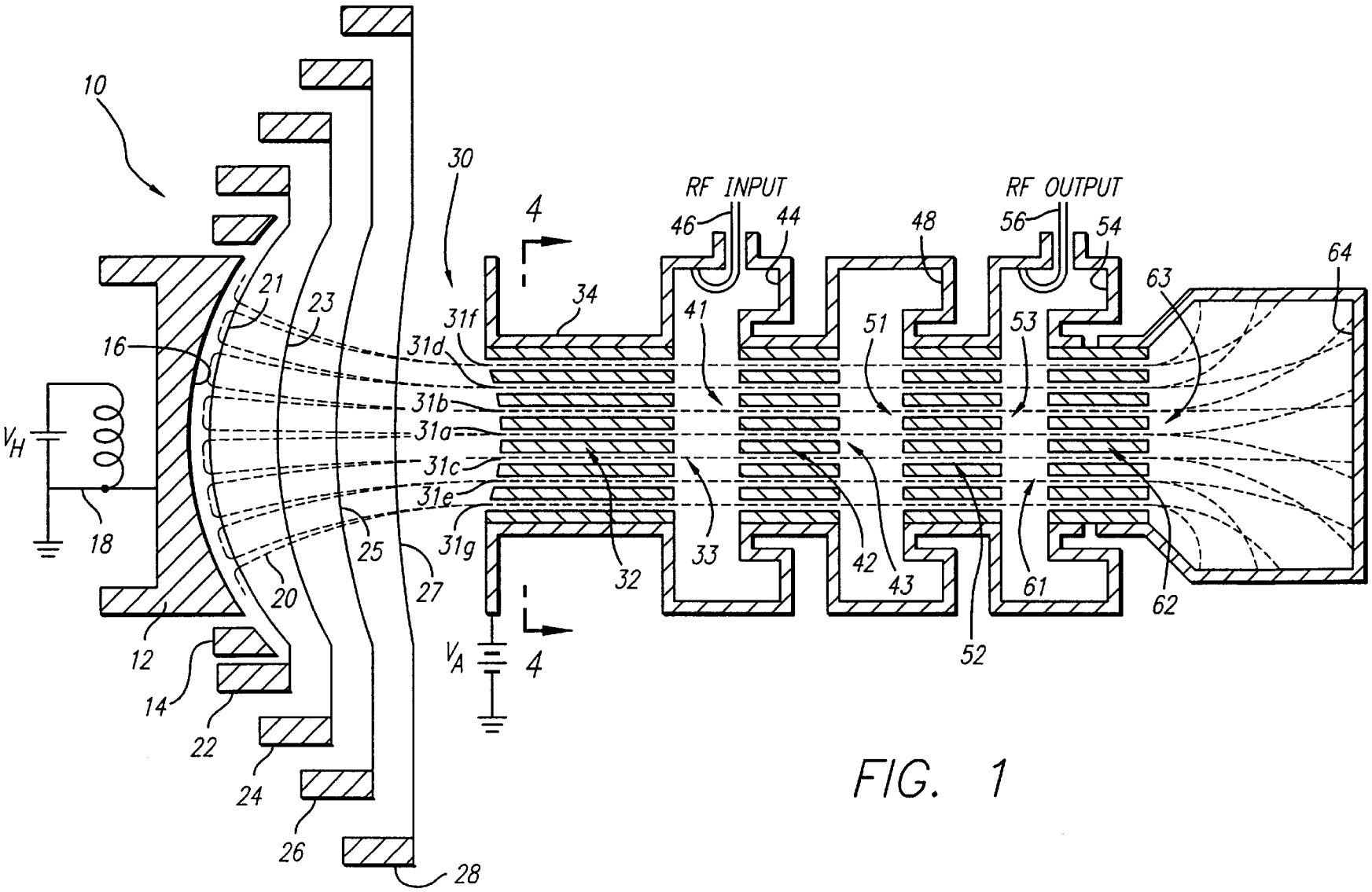
FIG. 1 is a sectional side view of a multiple beam klystron having an electron gun of the present invention.

The present invention satisfies the need for a convergent electron gun having a plurality of high current beamlets to permit construction of a multiple beam klystron providing high operating power at high frequencies. In the detailed description that follows, like element numerals are used to describe like elements illustrated in one or more of the figures.

As known in the art, conventional electron guns having a cathode and an anode are designed using sophisticated computer programs. These programs plot the equipotential contour surfaces defined by the electric field distribution formed by the cathode and anode, and introduce electron trajectories into the electric fields taking into account the potentials produced by space charge of the electrons. An example of such a computer program is DEMEOS written by Dr. Richard True of Litton Systems, Inc. Using such programs, electron guns with curvilinear electron trajectories have been designed to provide electron beams with a high degree of laminarity from the cathode to the minimum beam diameter. The present invention utilizes a variation of this method to produce a multiple beam electron gun.

In particular, a design for a multiple beam electron gun begins with a computer solution for a conventional laminar beam, axisymmetric electron gun. Then, a plurality of electrode grids are defined on equipotential contour surfaces, with perforations formed in the electrode grids which coincide with respective groups of electron trajectories from the cathode. These groups of electron trajectories are heretofore referred to as beamlets since they represent a subset of the original electron beam. The first electrode grid adjacent to the cathode is operated either at cathode potential and is closely spaced to the cathode, or it is located on an equipotential contour surface which is only slightly above the cathode potential, so that the electron current intercepted by the first electrode grid does not cause substantial dissipation of the electron beam.

The electron trajectories between the perforations of the electrode grids do not flow through the perforations and are intercepted by the electrode grids. However, by providing a sufficiently high number of electrode grids on equipotential contour surfaces, the potential between the beamlets varies in the same manner that the potential would vary in a conventional laminar flow beam. If the number of electrode grids on equipotential contour surfaces were reduced, such as to two or less electrode grids, the potential match at the edge of the beamlets may suffer to some extent, but the match would otherwise be adequate in many cases. The trajectories of the electrons of the beamlets would be further enhanced if a confining magnetic field shaped to the electron trajectories is used to focus the multiple electron beamlets.

Further, the perforations in the first electrode grid may be constructed with a conical shape in order to act as a focusing electrode to encourage rectilinear flow therethrough. An angle of approximately 67.5° formed by the interior surfaces of the conical perforations with respect to the normal to the grid would provide optimum beam shaping. This part of the electron flow nearest to the cathode experiences the greatest amount of space charge, and therefore, the shaping of the electrode grid around the beamlets in this region is most critical. It is also possible to select the shape and thickness of the electrode grids between the perforations to provide a better potential match along the beam edge by use of computer modeling, such as described above.

Figure 5:
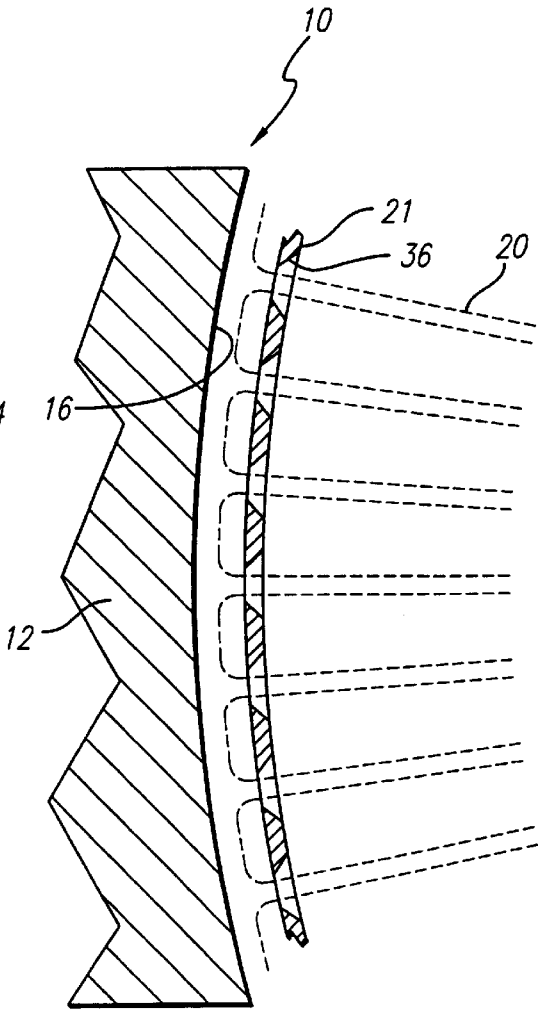
FIG. 5 is a enlarged view of the electron gun, illustrating a portion of the cathode and first grid used to provide multiple convergent beamlets.

Referring now to FIGS. 1 and 5, an embodiment of a multiple beam klystron is illustrated which includes an electron gun 10 constructed in accordance with the present invention. The electron gun 10 comprises a cathode 12 having a concave electron-emitting surface 16. A heater coil 18 (see FIG. 1) is potted within the cathode 12 and is electrically coupled to an external direct current (DC) power source ($V_H$) in FIG. 1. As known in the art, the heater coil 18 is used to raise the temperature of the cathode sufficiently to permit thermionic emission of electrons from the surface 16. An annular focus electrode 14 (see FIG. 1) is disposed concentrically around the outer peripheral portion of the cathode surface 16. The cathode 12 and focus electrode 14 are commonly coupled together at ground voltage potential.

Figure 4:
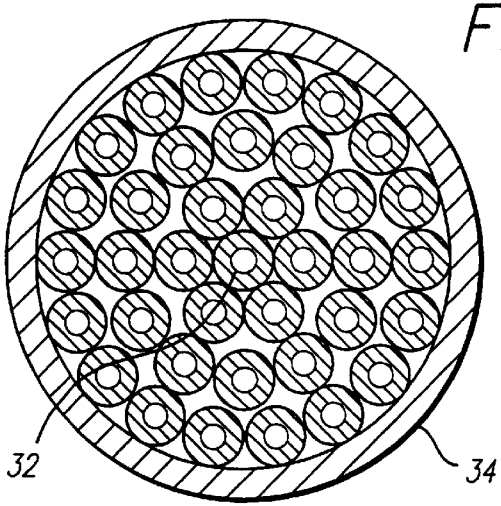
FIG. 4 is a sectional end view of the multiple drift tube bundles, as taken through section 4—4 of FIG. 1.

An anode 30 is defined by respective ends 31*a*–31*g* of a plurality of hollow drift tubes combined in a bundle (illustrated generally as 32 in FIG. 1). The drift tubes 32 are disposed in parallel with each other in a unitary bundle within an outer housing 34, with adjacent ones of the drift tubes in direct contact with each other as shown in FIG. 4. A centermost one of the drift tubes 32*a* (see FIG. 1) extends along a central axis of the klystron coextensive with a central portion of the cathode surface 16, with remaining ones of the drift tubes 32 disposed concentrically outward from the centermost drift tube 32*a*. The respective ends 31*a*–31*g* of the drift tubes 32 are disposed in a stepped manner with the centermost drift tube end 31*a* being most distant from the cathode surface 16 and the other drift tube ends 31*b*–31*g* being successively closer to the cathode surface. The ends 31*a*–31*g* of the drift tubes 32 collectively define a concave anode surface, with an inter-electrode space defined between the anode surface and the cathode surface 16. A positive voltage potential is applied by an anode voltage source ($V_A$) (see FIG. 1) to the anode 30 to define a series of equipotential contour surfaces (not shown) between the cathode surface 16 and the anode surface.

As can be seen from FIG. 1, a plurality of grids are disposed in the inter-electrode space between the cathode surface 16 and the anode 30. A first grid 21 (see also FIGS.) is closely spaced to the cathode surface 16 and is mounted within a first mounting cylinder 22. Following the first grid 21, a second grid 23 is mounted within a second mounting cylinder 24, a third grid 25 is mounted within a third mounting cylinder 26, and a fourth grid 27 is mounted within a fourth mounting cylinder 28. The grids 21, 23, 25 and 27 are disposed in the inter-electrode space coincident with corresponding ones of the equipotential contour surfaces, and have a shape which matches the corresponding equipotential contour surface. In particular, the first grid 21 (see also FIG. 2) has a smaller radius of curvature than the other grids, which mimics the curvature of the concave surface 16 of the cathode 12. Each successive grid which follows the first grid 21 has a greater radius of curvature than the first grid, such that the fourth grid 27 appears almost planar. The grids are comprised of an electrically conductive material, such as copper or molybdenum, and are electrically isolated from each other, and from both the cathode 12 and the anode 30. Though four grids are described with respect to the exemplary multiple beam klystron of FIG. 1, it should be appreciated that a greater or lesser number of grids may also be advantageously utilized.

Figure 2:
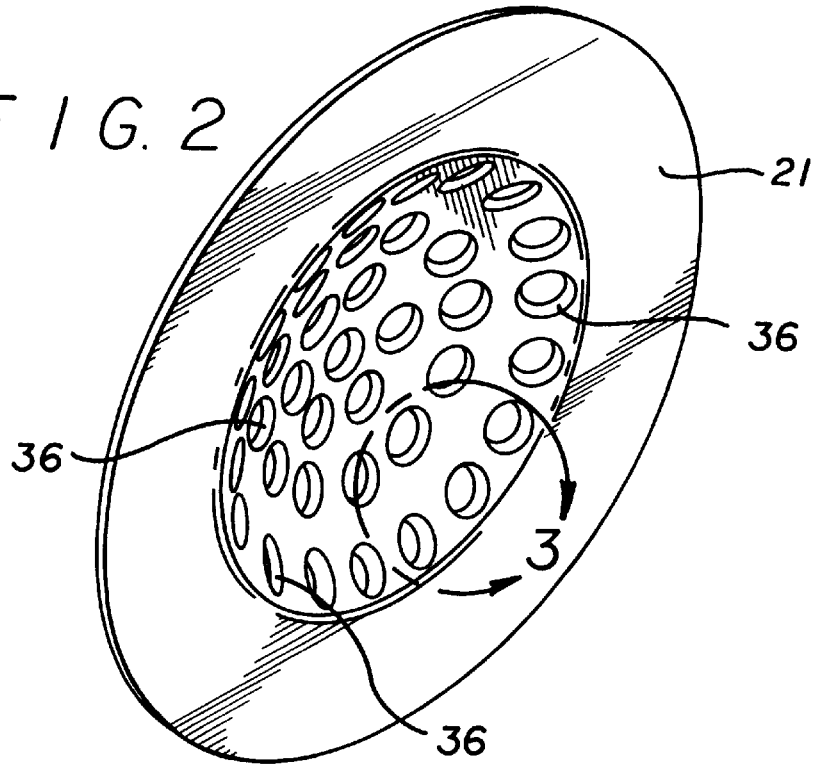
FIG. 2 is an enlarged perspective view of the first grid.
Figure 3:
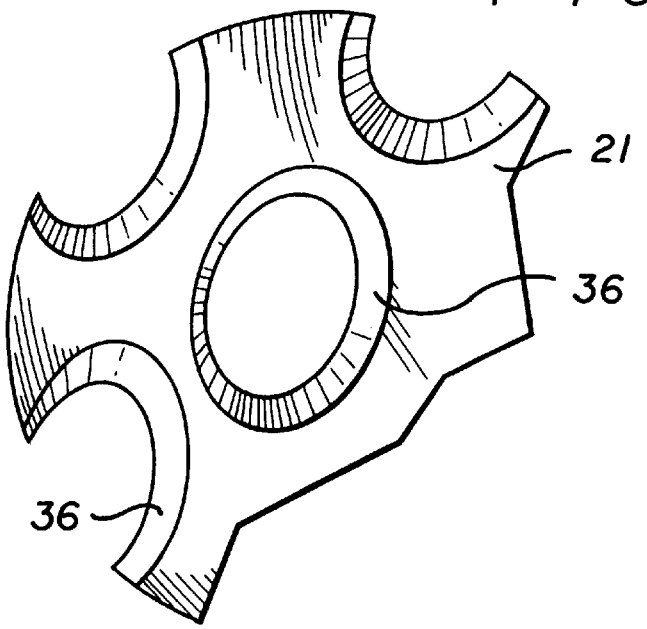
FIG. 3 is an enlarged perspective view of one of the perforation of the first grid, as taken from FIG. 2.

Each of the grids 21, 23, 25 and 27 include a plurality of spaced perforations arranged in substantial registration with each other and with corresponding ones of the drift tubes 32. Referring briefly to FIGS. 2 and 3, an enlarged portion of the first grid 21 is illustrated to show the perforations 36 in greater detail. The perforations 36 have a substantially conical shape, with a smaller circular opening at the side of the grid 21 facing the cathode, and a larger circular opening at the opposite side of the grid facing the anode 30. As described above, the conical shape of the perforation 36 acts as a focusing electrode to encourage rectilinear electron flow therethrough, and in a preferred embodiment of the invention, an approximately 67.5° angle is formed by the interior edges of the perforation with respect to the normal to the grid 21. Due to the proximity to the cathode surface 16, the conical shape of the first grid 21 has the greatest effect on beamlet shaping. Therefore, the perforations provided in the other grids 23, 25 and 27 may not necessarily include the conical shape, but instead may have another shape that is simpler to manufacture, such as cylindrical. In the alternative, all grids may be provided with the conical shape in the same manner as grid 21.

Returning to FIG. 1, the multiple beam klystron includes an RF section in which the energy of the multiple electron beamlets is transferred to an electromagnetic signal. The RF section includes a first cavity 44, an intermediate cavity 48, and a last cavity 54. The first cavity 44 includes an inductive coupling junction 46 to couple an electromagnetic signal into the first cavity, and the last cavity 48 includes an inductive coupling junction 56 to couple an electromagnetic signal out of the last cavity. Alternatively, capacitive coupling may be utilized to couple the electromagnetic signal into and out of the cavities, as known in the art.

The drift tubes 32 extend axially along the length of the klystron between the first respective ends 31*a*–31*g* providing the anode 30 and the second respective ends 33 which coincide with the first cavity 44. Similarly, drift tubes 42 extend axially between the first respective ends 41 which coincide with the first cavity 44 and the second respective ends 43 which coincide with the intermediate cavity 48. Drift tubes 52 extend axially between the first respective ends 51 which coincide with the intermediate cavity 48 and the second respective ends 53 which coincide with the last cavity 54. Drift tubes 62 extend axially between the first respective ends 61 which coincide with the last cavity 54 and the second respective ends 63 which terminate in a collector 64. The respective bundles of drift tubes 32, 42, 52, and 62 are disposed such that the individual drift tubes are in respective axial alignment. An input gap is defined between ends 33 and 41, an intermediate gap is defined between ends 43 and 51, and an output gap is defined between ends 53 and 61. With the exception of the first respective ends 31*a*–31*g* of the drift tubes 32 which are staggered to define the concave anode surface as described above, all of the other respective ends of the drift tubes terminate flush at the respective gaps In some applications, it might be advantageous to replace a few of the central drift tubes with a solid metallic rod that is somewhat shorter than the remaining annular groups of drift tubes in order to make the electric field more uniform over the remaining gaps.

In operation of the multiple beam klystron, a positive voltage potential is applied to the anode 30 (see FIG. 1), which draws electrons that have been thermionically emitted from the cathode surface 16. The electrons having a trajectory coinciding with the perforations 36 pass through the grids as a plurality of electron beamlets 20, as also illustrated in FIG. 5. The beamlets 20 are introduced into respective ones of the drift tubes 32, and are transported therethrough in a compressed manner by operation of a confining magnetic field defined axially along the length of the klystron. The beamlets 20 continue to travel through the drifts tubes 42, 52, and 62, and are ultimately deposited in the collector 64 where the electrons of the beamlets diverge due to space charge.

An RF input signal is inductively coupled into the first cavity 44, and the electrons traversing the gap between respective drift tubes 32 and 42 become velocity modulated by the RF input signal. The electron bunching becomes reinforced as the electrons traverse the gap at the intermediate cavity 48 between respective drift tubes 42 and 52, which increases the gain of the klystron. The electron bunches that traverse the gap at the last cavity 54 induce an electromagnetic wave in the last cavity, which is extracted inductively as an amplified RF output signal. It should be appreciated that a greater or lesser number of resonant cavities may be utilized to achieve desired amplification characteristics of a multiple beam klystron.

Figure 6:
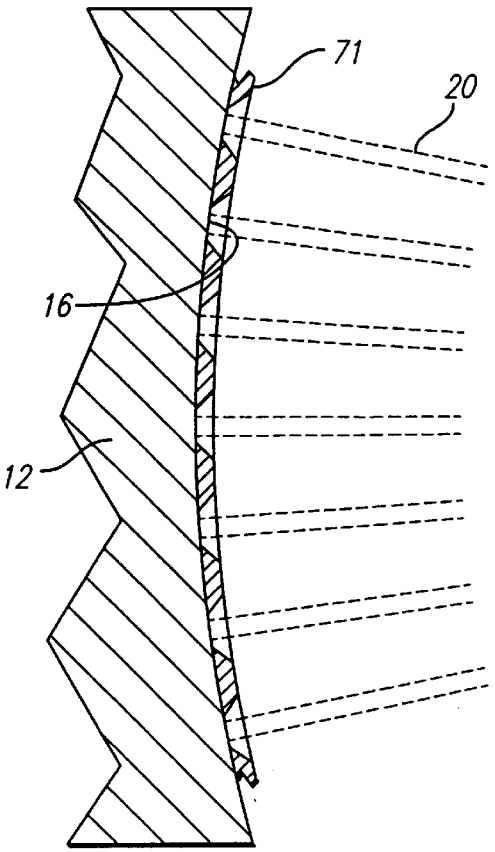
FIG. 6 is a enlarged view of an alternative embodiment of the electron gun, illustrating a portion of the cathode having emissive and non-emissive regions to provide multiple convergent beamlets.

Referring lastly to FIG. 6, an alternative embodiment of the cathode 12 is illustrated. The surface 16 of the cathode 12 is provided with non-emissive regions 71 so that a plurality of convergent beamlets 20 are formed. The non-emissive regions 71 may be formed by affixing the first grid directly to the cathode surface 16, with the portions of the cathode surface that are exposed through the non-emissive regions providing emissive regions. The emissive regions may also be formed by applying an electron emissive material, such as nickel, in a desired pattern onto the cathode surface. In this alternative embodiment, it may only be necessary to include one additional grid in the interelectrode space in order to provide sufficient beamlet formation and focusing.

Having thus described a preferred embodiment of the electron gun for use in a multiple beam klystron, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A multiple beam klystron, comprising:

a cathode having an emitting surface;

an anode having a surface defined by first respective ends of a plurality of hollow drift tubes, said anode surface being spaced from said cathode surface and having a positive voltage potential applied thereto;

a plurality of grids located between said cathode and said anode, each one of said grids having a respective plurality of perforations extending therethrough in substantial registration with each other and with corresponding openings of said plurality of drift tubes;

a first resonant cavity defined by a first gap provided in said plurality of drift tubes, an outer housing, and means for coupling an electromagnetic signal into said first resonant cavity;

a second resonant cavity defined by a second gap provided in said plurality of drift tubes, said outer housing, and means for extracting an electromagnetic signal from said second resonant cavity; and a collector disposed at second respective ends of said plurality of drift tubes, wherein a plurality of electron beamlets are drawn from said cathode surface through respective ones of said plurality of perforations and into corresponding ones of said plurality of drift tubes, said beamlets being deposited into said collector after passing across said first and second gaps;

wherein each of said plurality of perforations of a first one of said grids further comprises a respective conical shape with a smaller opening facing said cathode.

2. An electron gun providing multiple convergent beamlets, comprising:

a cathode having an emitting surface;

an anode having a surface defined by respective ends of a plurality of hollow drift tubes, said anode surface being spaced from said cathode surface and having a positive voltage potential applied thereto;

a plurality of grids located between said cathode and said anode, each one of said grids having a respective plurality of perforations extending therethrough in substantial registration with each other, and with corresponding openings of said plurality of drift tubes;

wherein, a plurality of electron beamlets are drawn from said cathode surface through respective ones of said plurality of perforations into respective openings of said plurality of drift tubes; and wherein said anode has a concave surface defined by said respective ends of said plurality of hollow drift tubes.

3. The electron gun of claim 2, wherein said plurality of hollow drift tubes are disposed in parallel in a unitary bundle.

4. An electron gun providing multiple convergent beamlets, comprising:

a cathode having a concave emitting surface;

an anode having a concave surface spaced from said cathode surface and having a positive voltage potential applied thereto to define a series of equipotential contour surfaces between said cathode and said anode;

a plurality of grids located between said cathode and said anode, each one of said grids being respectively disposed substantially coincident with a corresponding one of said equipotential contour surfaces, said each one of said grids further having a respective plurality of perforations extending therethrough in substantial registration with each other;

wherein, a plurality of electron beamlets are drawn from said cathode surface through respective ones of said plurality of perforations to said surface of said anode;

wherein a first one of said grids is located closely adjacent to said cathode surface;

wherein each of said plurality of perforations of a said first one of said grids further comprises a respective conical shape with a smaller opening thereof facing said cathode.

5. An electron gun, comprising:

a cathode having an emitting surface;

an anode having a surface defined by respective ends of a plurality of hollow drift tubes, said anode surface being spaced from said cathode surface and having a positive voltage potential applied thereto; and means for shaping an electron beam emitted from said cathode emitting surface into a plurality of beamlets following a convergent path between said cathode and said anode, each of said plurality of beamlets being drawn into respective openings of said plurality of drift tubes;

wherein said shaping means further comprises a plurality of grids located between said cathode and said anode;

wherein said each one of said grids further comprises a plurality of perforations respectively extending therethrough in substantial registration with each other and with said corresponding openings of said plurality of drift tubes; and wherein each of said plurality of perforations of a first one of said grids further comprises a respective conical shape.

* * * * *